US007861901B2

(12) United States Patent
Kirschbaum

(10) Patent No.: US 7,861,901 B2
(45) Date of Patent: Jan. 4, 2011

(54) PANTS HANGER SYSTEM

(76) Inventor: Phillip Kirschbaum, 415 Douglas St., Petaluma, CA (US) 94952

( * ) Notice: Subject to any disclaimer, the term of this patent is extended or adjusted under 35 U.S.C. 154(b) by 205 days.

(21) Appl. No.: 12/321,149

(22) Filed: Jan. 21, 2009

(65) Prior Publication Data

US 2010/0181351 A1 Jul. 22, 2010

(51) Int. Cl.
*A41D 27/22* (2006.01)

(52) U.S. Cl. ..... 223/96; 223/85; 223/95; 211/85.3; 211/89.01

(58) Field of Classification Search ..... 223/85, 223/88, 91, 95, 96; 211/32, 85.3, 87.01, 211/89.01, 113
See application file for complete search history.

(56) References Cited

U.S. PATENT DOCUMENTS 713,139 A * 11/1902 Nosker ..... 211/51
3,967,346 A * 7/1976 Young, Jr. ..... 211/89.01
4,291,810 A * 9/1981 Rubenstein ..... 211/89.01
5,188,325 A * 2/1993 Hilty et al. ..... 211/32
5,515,978 A * 5/1996 Moran ..... 211/89.01
6,223,910 B1 * 5/2001 Levin et al. ..... 211/113
2005/0109802 A1 * 5/2005 Avery et al. ..... 223/85
2005/0155944 A1 * 7/2005 Wenzler ..... 211/85.3
2005/0155946 A1 * 7/2005 Wenzler ..... 211/85.3
2006/0011671 A1 * 1/2006 Wenzler ..... 223/85

* cited by examiner

*Primary Examiner*—Gary L Welch
*Assistant Examiner*—Nathan E Durham

(57) ABSTRACT

A pants hanging system with a vertically disposed hanger strip, a plurality of elongate hanger receiving members and a plurality elongate semi rigid pants hanging members. The hanger receiving members are attached to the hanger strip in an equal spacing one above the other. The hanger receiving members are formed into a U shaped profile. The pants hanging members have a teardrop shaped profile. The bottom most portion of the teardrop shape includes a gap capable of removably retaining the cuff portion of a pair of pants. The rear, wall facing side of each the pants hanging member includes a horizontally disposed inverted U shaped profile. The U shaped portion of the hanger receiving member can slidably engage with the inverted U shaped portion of the pants hanging member to removably retain the pair of pants.

5 Claims, 12 Drawing Sheets

PANTS HANGER SYSTEM

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of clothing organizers and more specifically to a pants hanger system.

Devices for hanging a pair of pants have been in existence for many years and are well known. The most common pants hanger has a horizontally disposed hanging bar that is connected by at least one rigid elongate member to an inverted U shaped member that can be removably supported by a rigid horizontal rod that is mounted within a standard clothes closet. The most typical pants hangers are constructed of wire, wood or plastic and can double as a shirt hanger in that the elongate members and the attached hanging bar form a shallow triangular shape where a pair of pants can be folded over the hanging bar, and a shirt or jacket can be hung over the sloping elongate members.

There are some hanger designs available in the market that are specifically designed for pants only. These designs usually attempt to grasp the cuff portion of the pants so that the remainder of the pant hangs down vertically. These designs usually require a somewhat difficult two handed operation where a clamping member is lifted, the pant cuff is placed between the clamping member and a non movable member, and then the clamping member is forced down over the pant cuffs to retain the pants. These types of pant hangers save space in a closet in that, instead of each pair of pants being folded over a hanger bar, the clamping type pants hangers can be grouped one above the other in a single pants hanging apparatus that allows the pants to be positioned more closely together and thereby save space in a closet.

However, there are several deficiencies in the prior technology. First, the crimping system described above tends to deform the pant material so that when the pant is removed from the hanger, there is an unwanted crease. Second, Many of the existing designs force the user to perform the pants hanging action while in the closet because the pants hanging members are physically connected to each other and can not be removed one at a time. This can be inconvenient for the user. Finally, the current dedicated pants hanger designs tend to be difficult to use in that the user has to hold the pants with one hand, open the spring biased clamping bar with the other hand and then try to place the pant cuffs perfectly within the opened clamp before letting the clamp close. This action requires a level of dexterity that some user's do not have.

BRIEF SUMMARY OF THE INVENTION

The primary object of the invention is to provide a pants hanger system that can hang a plurality of pants in a small space.

Another object of the invention is to provide a pants hanger system that allows the user to easily and quickly insert and remove pants as needed.

Another object of the invention is to provide a pants hanger system that can be mounted to any vertical wall or door.

A further object of the invention is to provide a pants hanger system that allows the user to have easy access to pants that overlap one another while hanging.

Another object of the invention is to provide a pants hanger system that does not put a crease in the cuff portion of the pants being hung Yet another object of the invention is to provide a pants hanger system that can be compactly stored and packaged.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed pants hanger system comprising: a vertically disposed hanger strip capable of being attached to a wall or door by standard means, a plurality of horizontally disposed elongate rigid hanger receiving members, a plurality of horizontally disposed elongate semi rigid pants hanging members, said hanger receiving members being centrally and fixedly attached to said hanger strip in an equal spacing one above the other, said hanger receiving members being formed into a U shaped profile, said pants hanging members having an inverted teardrop shaped profile wherein the bottom most portion of said teardrop section includes a gap capable of removably retaining the cuff portion of a pair of pants. The front, outwardly facing side of each said pants hanging member having a flared pant cuff receiving edge portion at each end, the rear wall facing side of each said pants hanging member having a horizontally disposed inverted U shaped profile portion fixedly attached, and said U shaped portion of said hanger receiving member capable of being slidably engaged with said inverted U shaped portion of said pants hanging member to removably retain said pair of pants.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
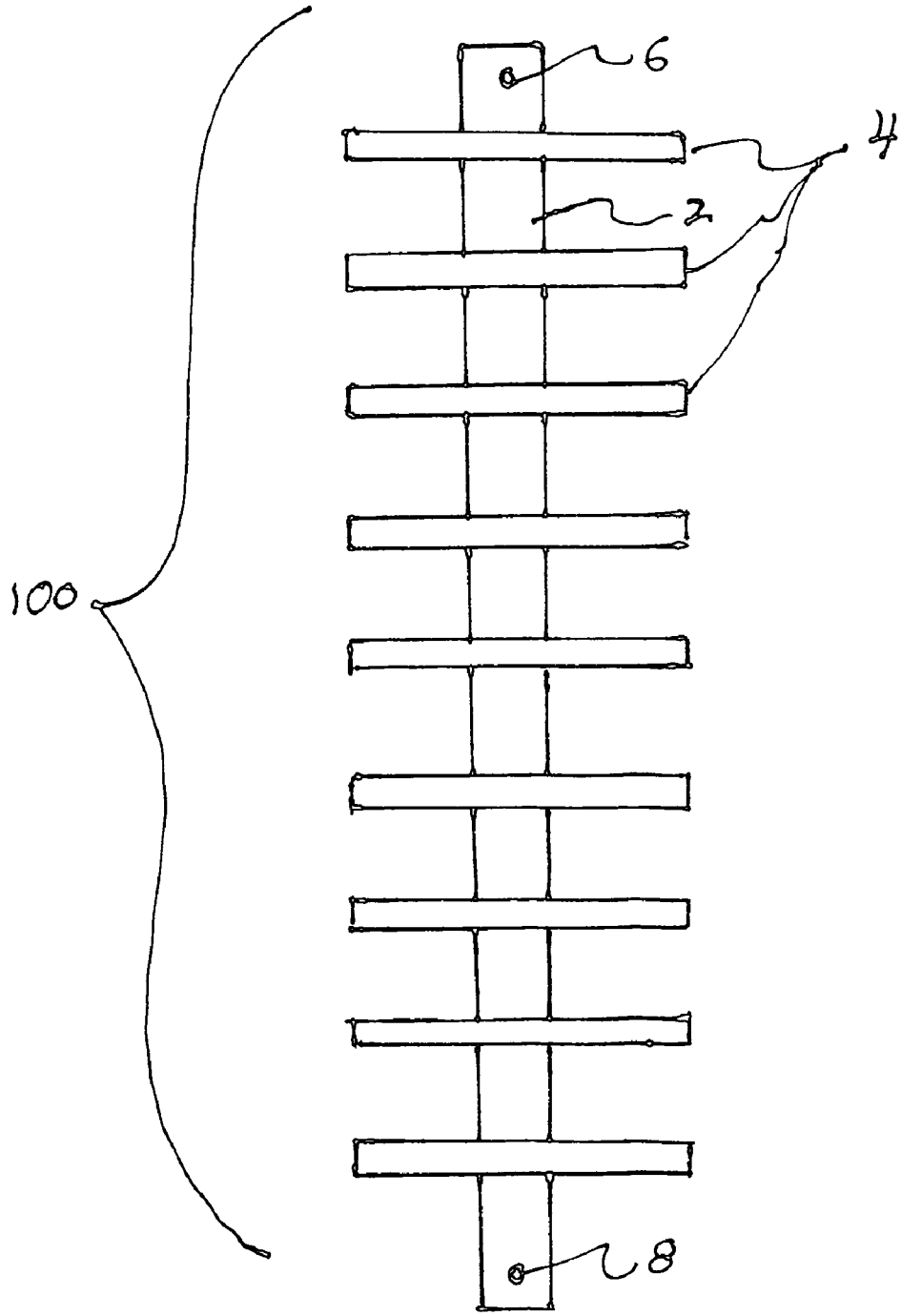
FIG. 1 is a front view of the vertical hanger strip and hanger receiving members of the present invention.
Figure 2:
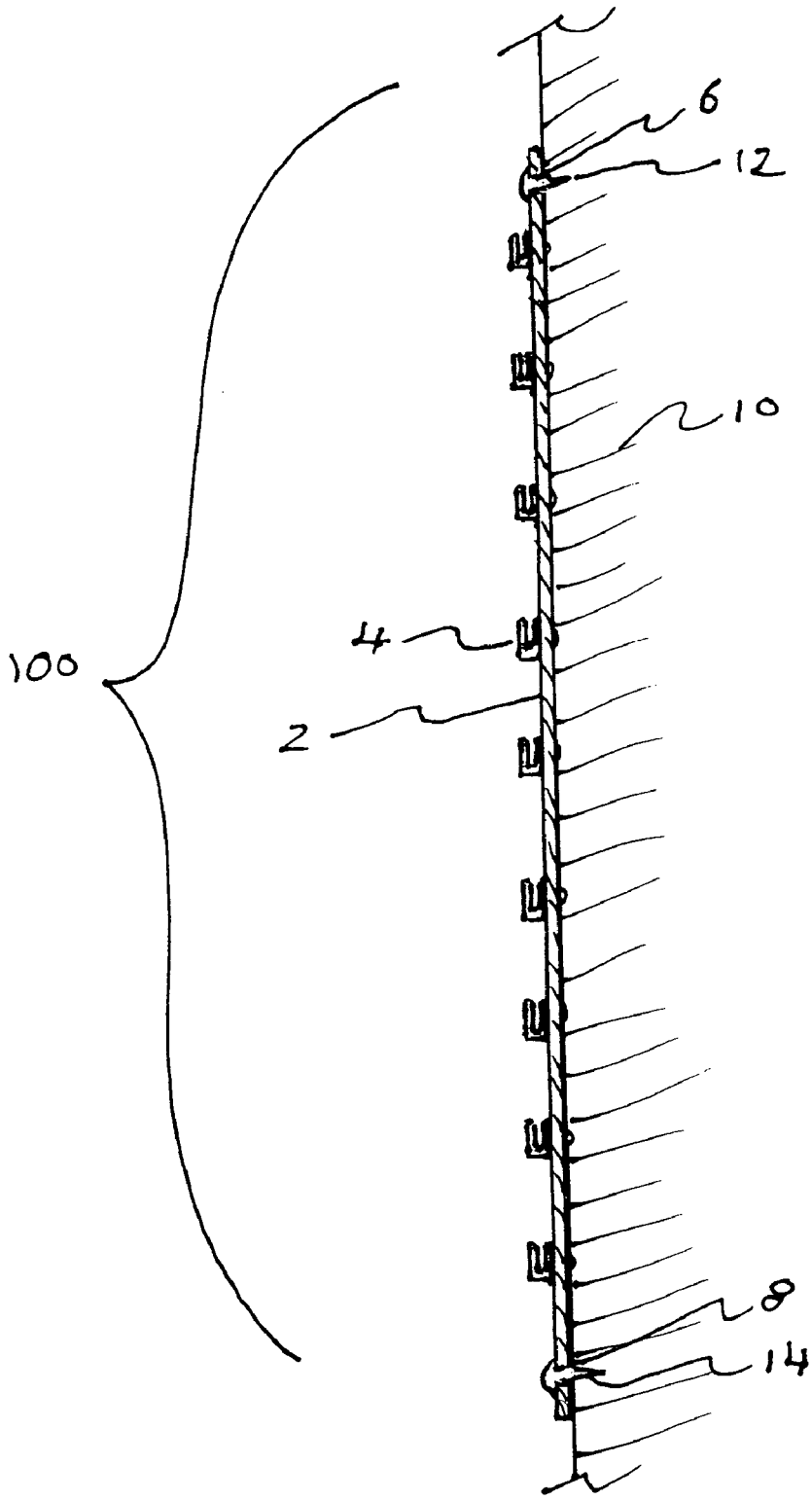
FIG. 2 is a side section view of the vertical hanger strip and hanger receiving members of the present invention.

Referring now to FIG. 1 we see a front view of the hanger receiving assembly 100 of the present invention. A plurality of horizontally disposed elongate hanger receiving members 4 are fixedly attached, one above the other onto a vertically oriented hanger strip 2 preferably made of polyester strap material so that the entire strip 2 and hanger receiving members 4 can be rolled up for compact storage and shipping. An upper aperture 6 and a lower aperture 8 allow the user to insert screws or other standard fastening means to attach the strip to a wall or a door as shown in the side section view in FIG. 2 which vertically bisects the assembly 100 where screws 12, 14 fasten the strip 2 to a wall 10. The strip 2 may be attached to a wall located inside a user's closet or on any vertical surface. FIG. 2 shows that the hanger receiving members 4 have a U shaped profile.

Figure 3:
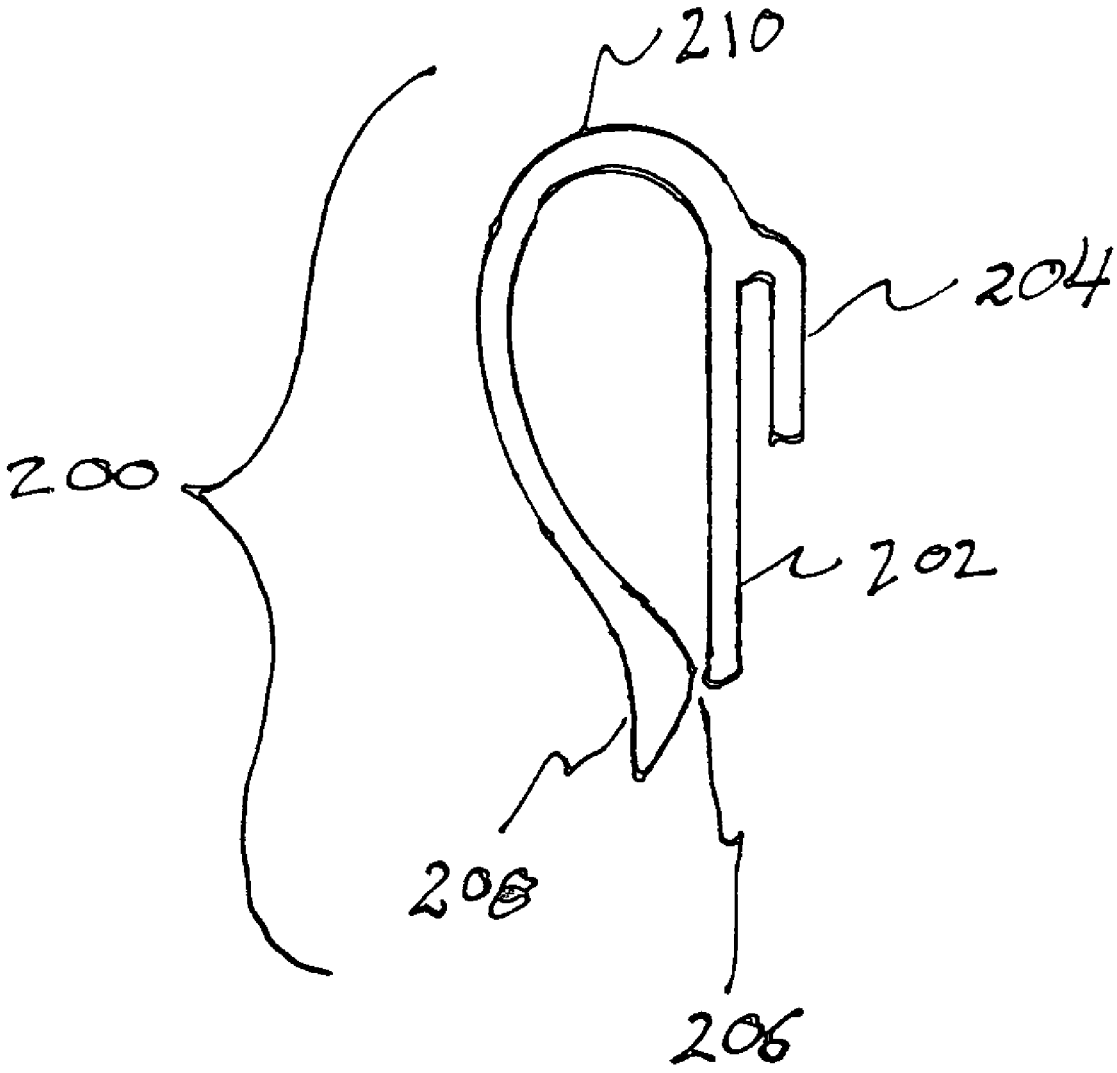
FIG. 3 is a side view of a pant hanging member of the present invention.

FIG. 3 shows a side profile view of a pants hanger member 200 of the present invention. The main body 210 of the hanger member 200 is approximately tear drop shaped having a flat rear wall 202. The bottom portion of the tear drop shape 210 includes a gap 206 that can allow pants cuffs to be slid in. The hanger member 200 is preferably made of resilient ABS plastic or commonly used resilient materials to allow the gap portion 206 of the teardrop shape 210 to be forced open when pants cuffs are slid in, but to have enough spring bias capability to cause the teardrop shape to close and grasp the pant cuffs. The rear wall 202 of pants hanger member 200 includes an inverted U shape portion 204 that can slidably engage with the U shaped portion of hanger receiving member 4. Flared portion 208 helps the user to guide the pant cuffs into gap 206 without having to use a second hand to spread the bottom portion of the teardrop shape 210.

Figure 4:
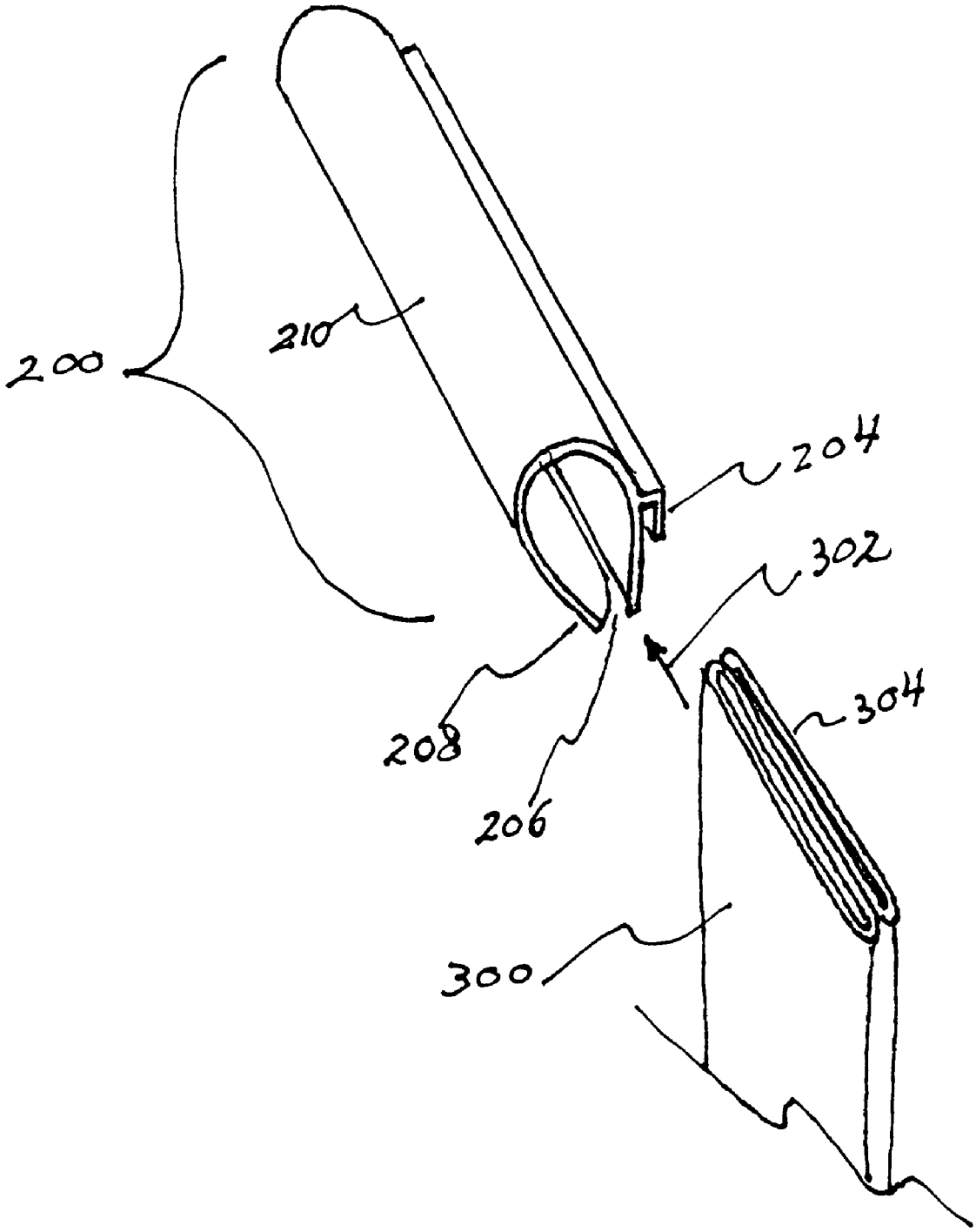
FIG. 4 is a perspective view of a pant hanging member of the present invention.

FIG. 4 shows a perspective view of a pants hanger member 200 with a pair of pants 300 about to be inserted into the hanger 200 as shown by direction arrow 302. This view helps show the flared portion 208 that can be found at either end of the front surface of hanger member 200. When the pant cuffs 304 are slid into gap 206, the flair portion 208 helps guide the cuff into the gap 206. My experiments have shown that a teardrop profile shape having a height of approximately two and one quarter inches and wall thickness of approximately one tenth of and inch provides sufficient spring action to hold a pair of pants securely, but not so much compression that the pant cuff is deformed when taken out of the hanger 200 after a period of time. This type of deformation problem is present in many of the pants hangers on the market today. Inverted U shape 204 can be seen on the rear surface of the pant hanger member 200. Because the pant hanger 200 can be removed from the hanger receiving assembly 100, it allows the user to insert or remove a pair of pants in a convenient location, other than within a closet.

Figure 5:
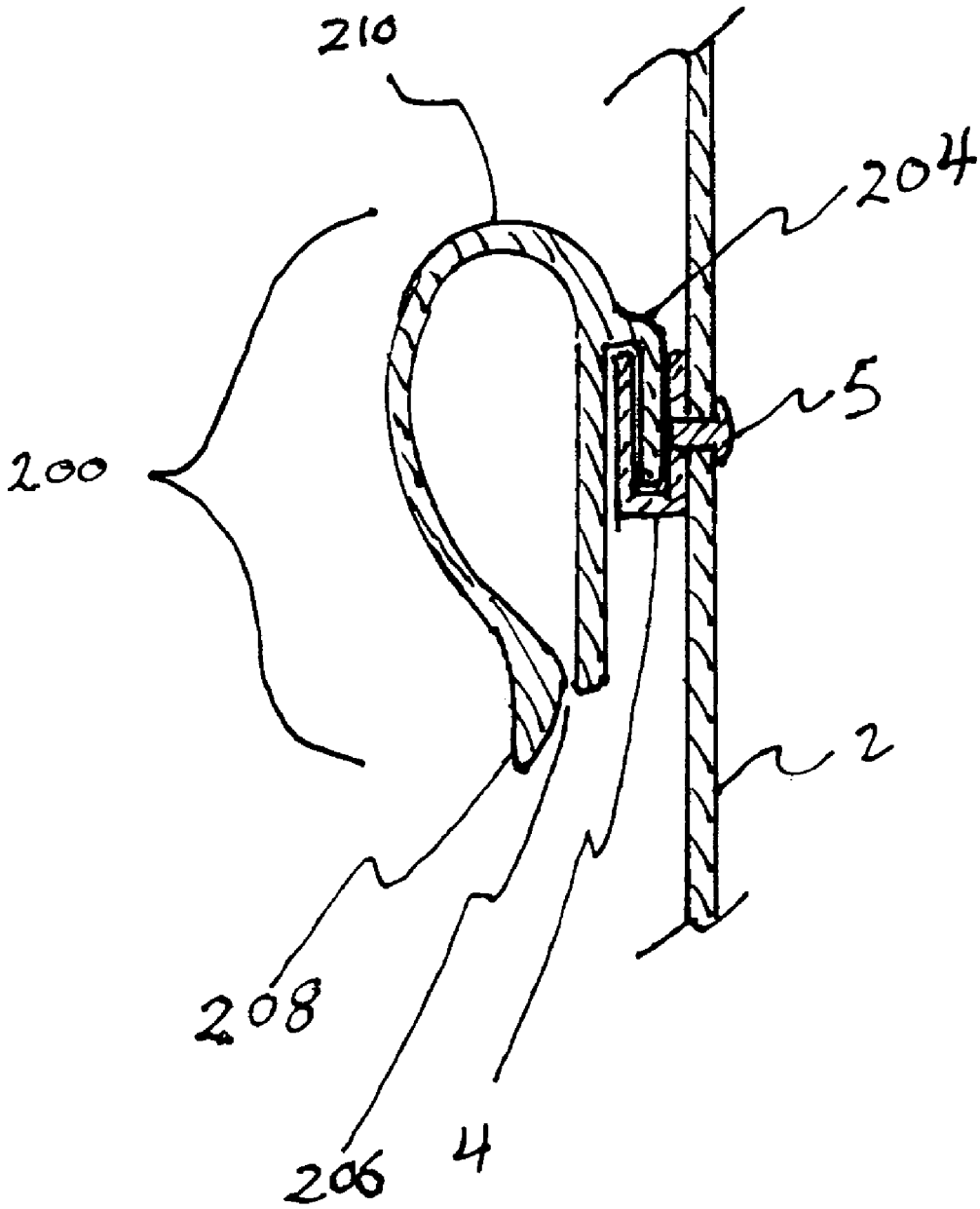
FIG. 5 is a side section view of a pants hanging member engaged with a hanger receiving member.

FIG. 5 shows a section view of hanger member 200 with its inverted U shape 204 engaged with U shape 4 of the hanger receiving assembly 100. This view also shows a rivet 5 which is one standard method of fixedly attaching the U shaped member 4 to the hanger strip 2. This view clearly shows how a user can slide, or drop in inverted U shape 204 with U shape 4. The inverted U portion 204 can be either dropped into U portion 4 from above, or it can be slid in to U portion 4 from the side.

Figure 6:
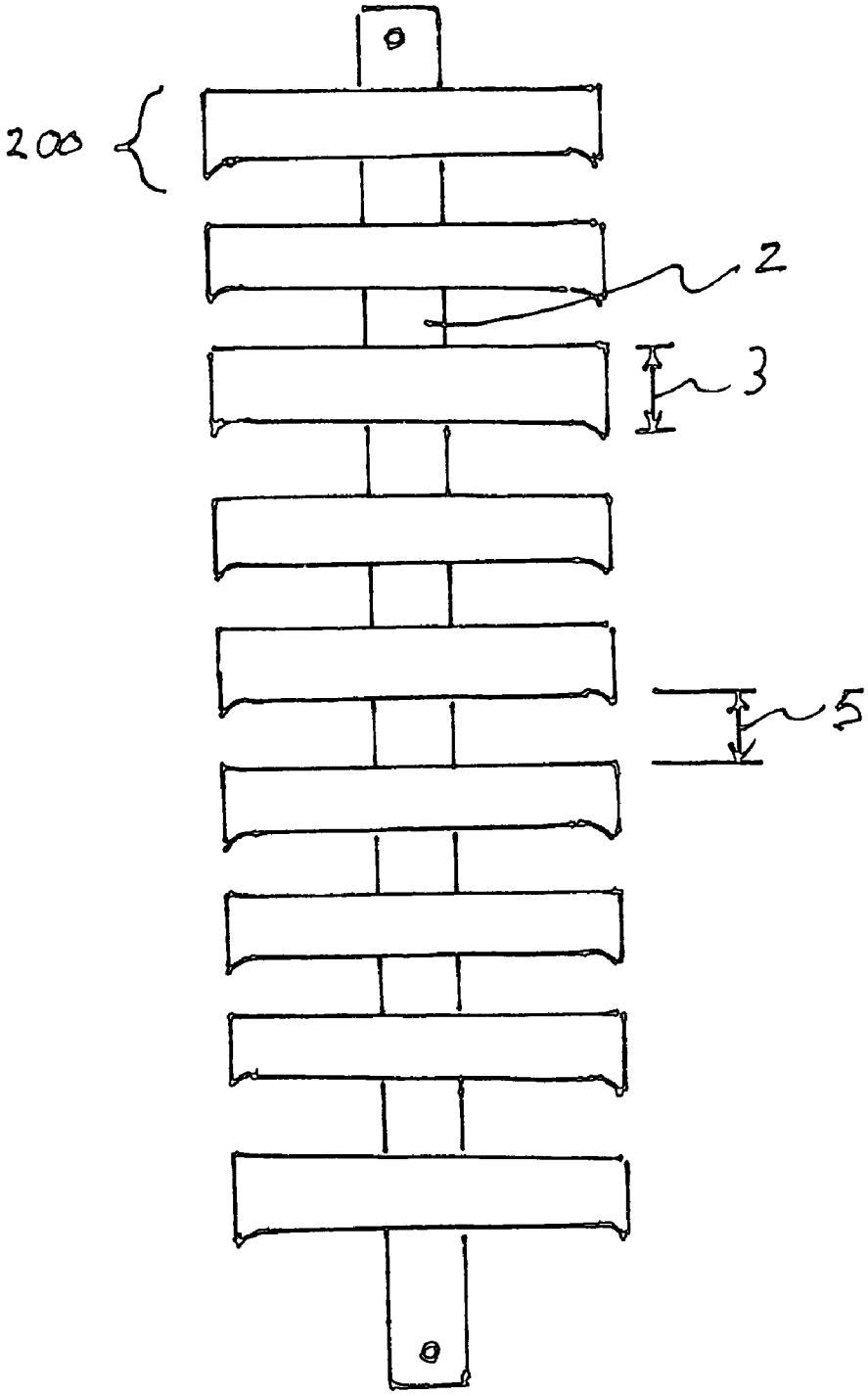
FIG. 6 is a front view of the vertical strip and hanger receiving members with the pants hanging members in place.
Figure 7:
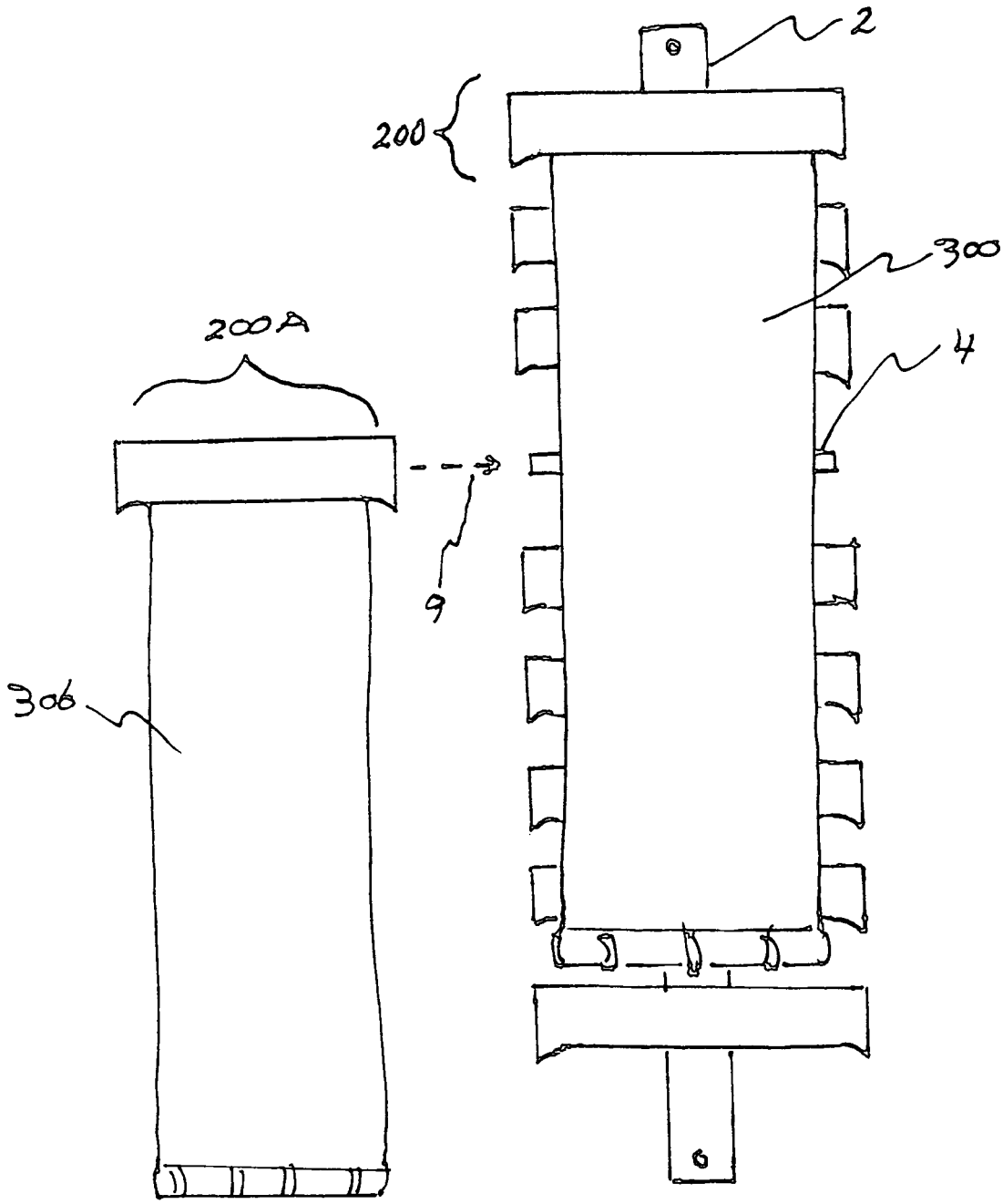
FIG. 7 is a front view of the vertical strip and hanger receiving members with a pair of pants being hung.

FIG. 6 shows a front view of the hanger strip 2 with a plurality of hanger members 200 attached. Each hanger member is approximately two and one quarter inches tall as shown by dimension line 3, and ten inches wide. The spacing between hanger members as indicated by dimension line 5 is approximately two and one quarter inches. This space gives adequate room for a user to slide a hanger member 200 in or out even when pants are hung on hanger members immediately above and below FIG. 7 shows one pair of pants 300 being hung on hanger member 200 and in place on the hanger receiving assembly 100. A second pair of pants 306 is hung on a separate hanger member 200 A and is about to be slid onto hanger receiving member 4 as shown by arrow 9.

Figure 8:
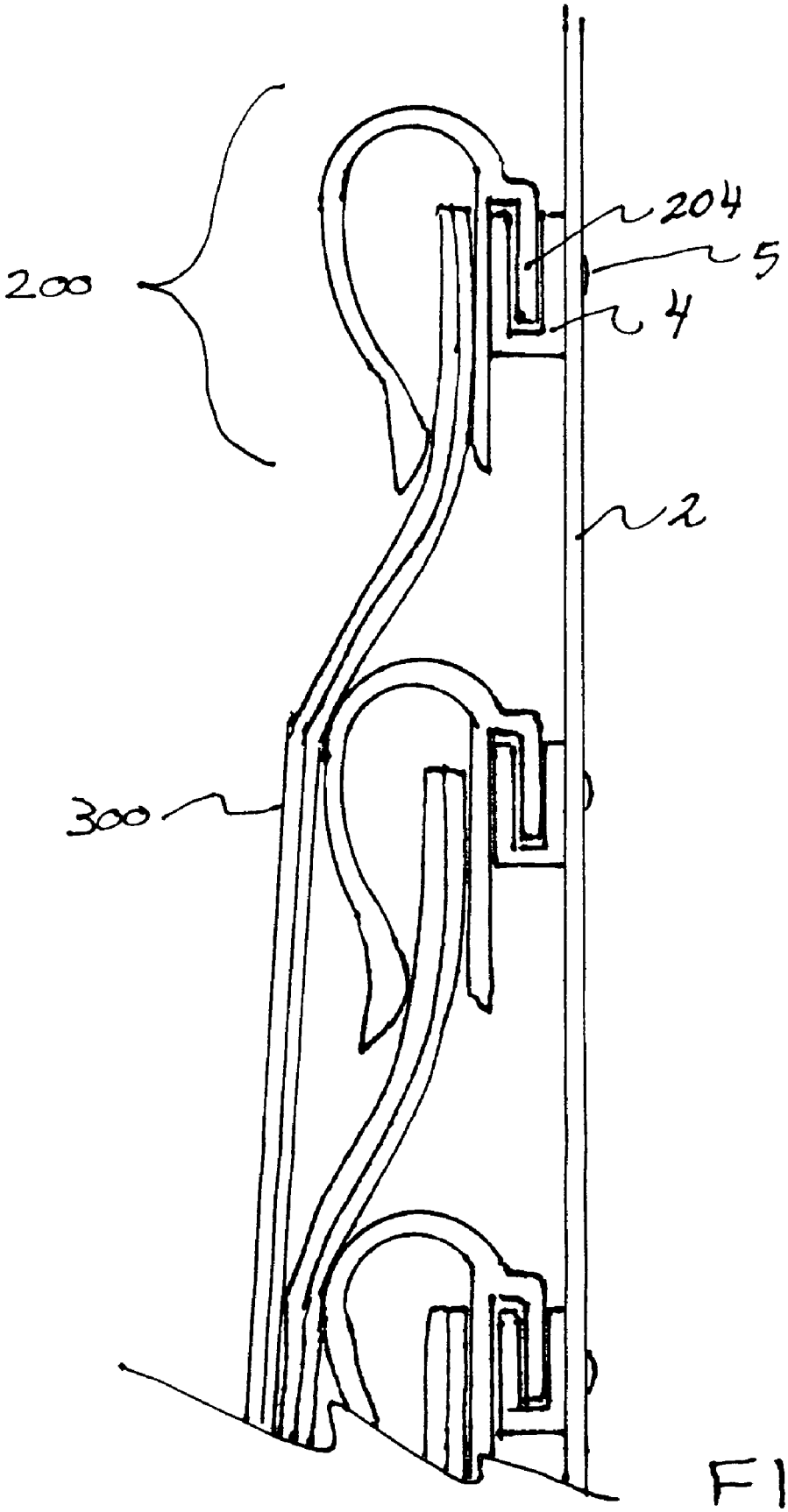
FIG. 8 is a partial side view of a plurality of pants hanger members with pants being hung

FIG. 8 shows a side view of hanger members 200 each retaining a pair of pants 300. The distance between hanger members 200 is sufficient to allow pants to drape over the next lower hanging member 200 without creasing.

Figure 9:
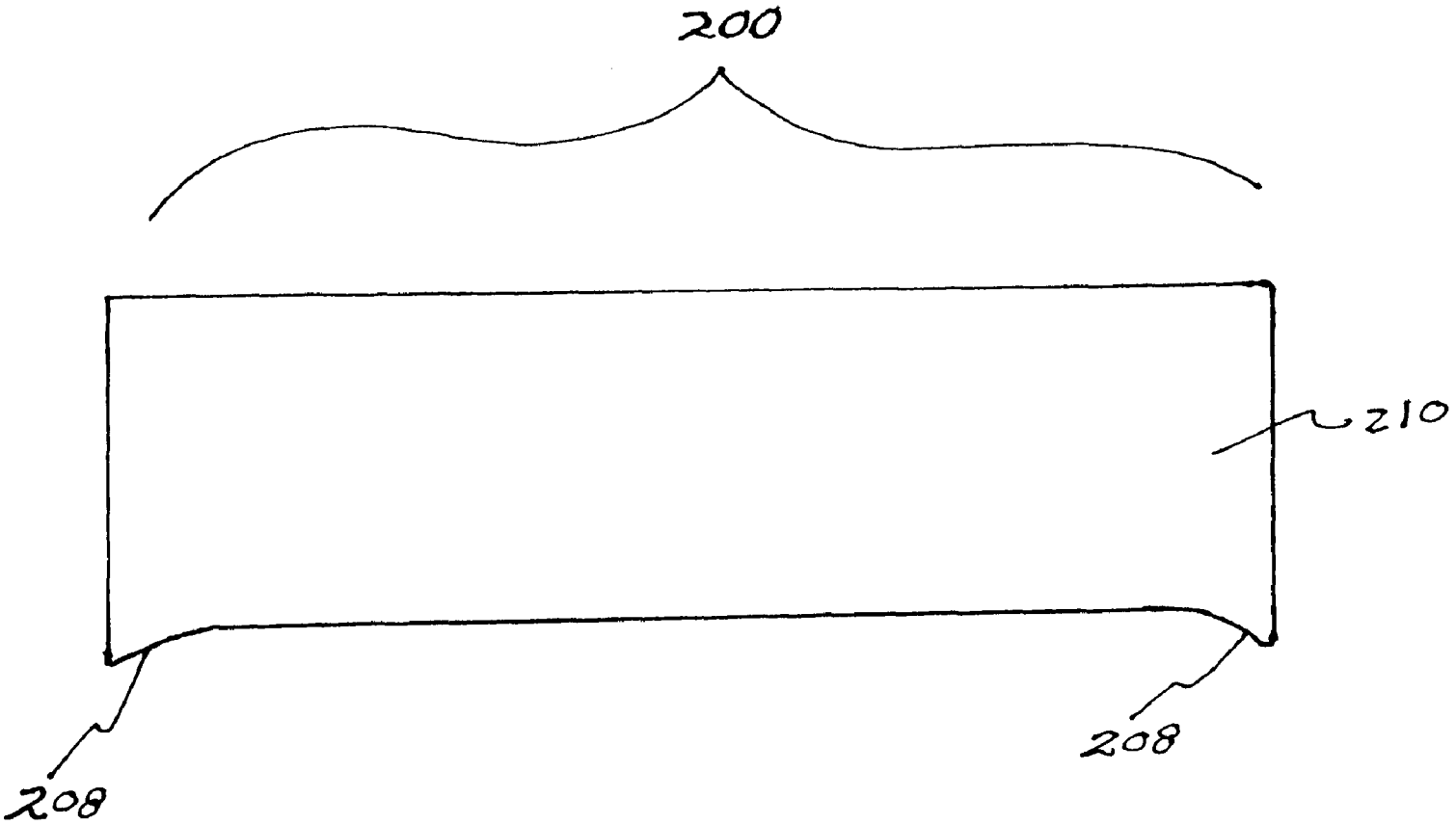
FIG. 9 is a front view of a pants hanging member.

FIG. 9 shows a front view of hanger member 200 clearly showing front portion 210 and flange portions 208

Figure 10:
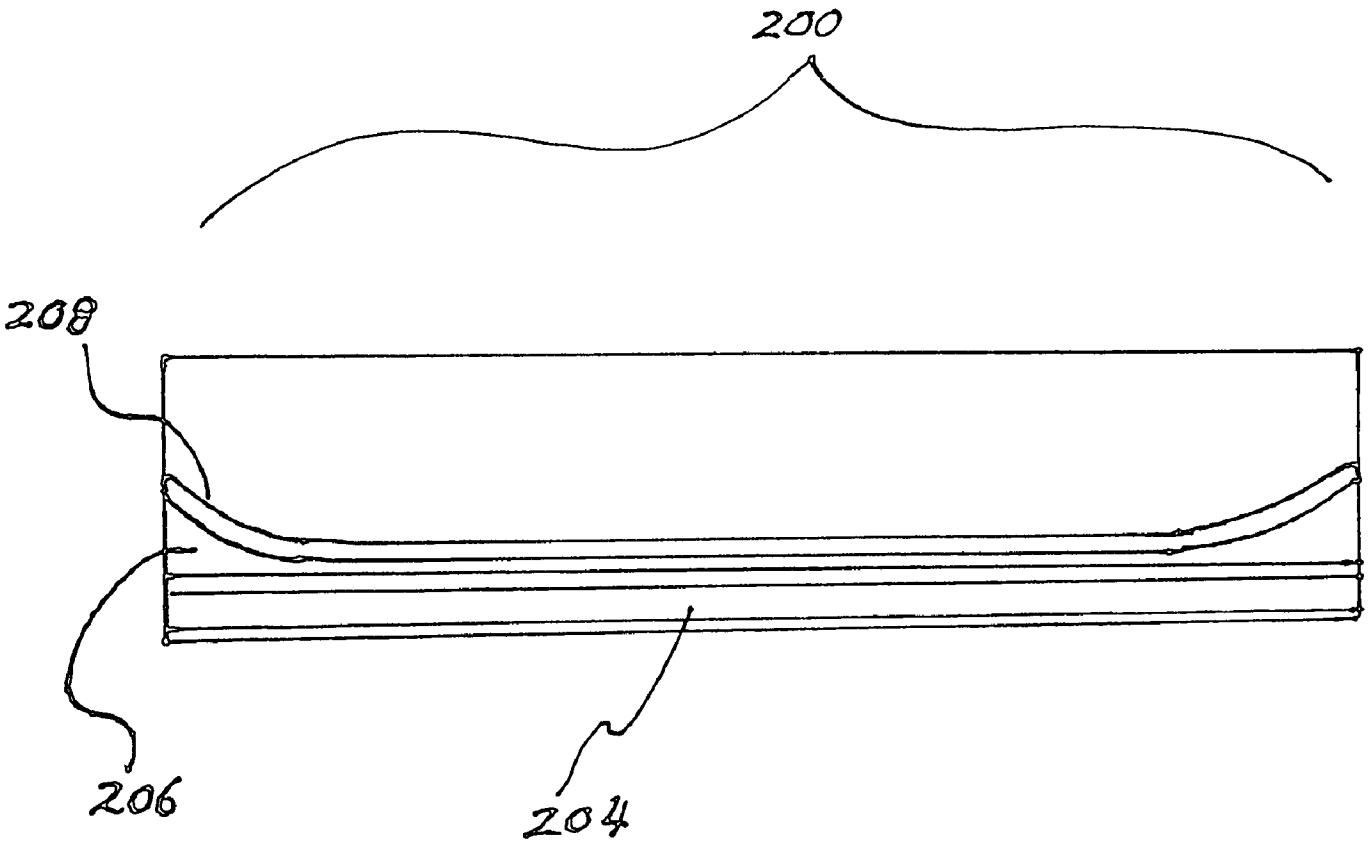
FIG. 10 is a bottom view of a pants hanging member.

FIG. 10 shows a bottom view of hanger member 200 clearly showing the flared portion 208 that creates a funnel type gap 206 allowing a user to slide in a pair of pants without having to physically separate the bottom gap portion 206 with a second hand thereby leaving one hand free for holding the hanger member 200 and the other hand free for holding a pair of pants.

Figure 11:
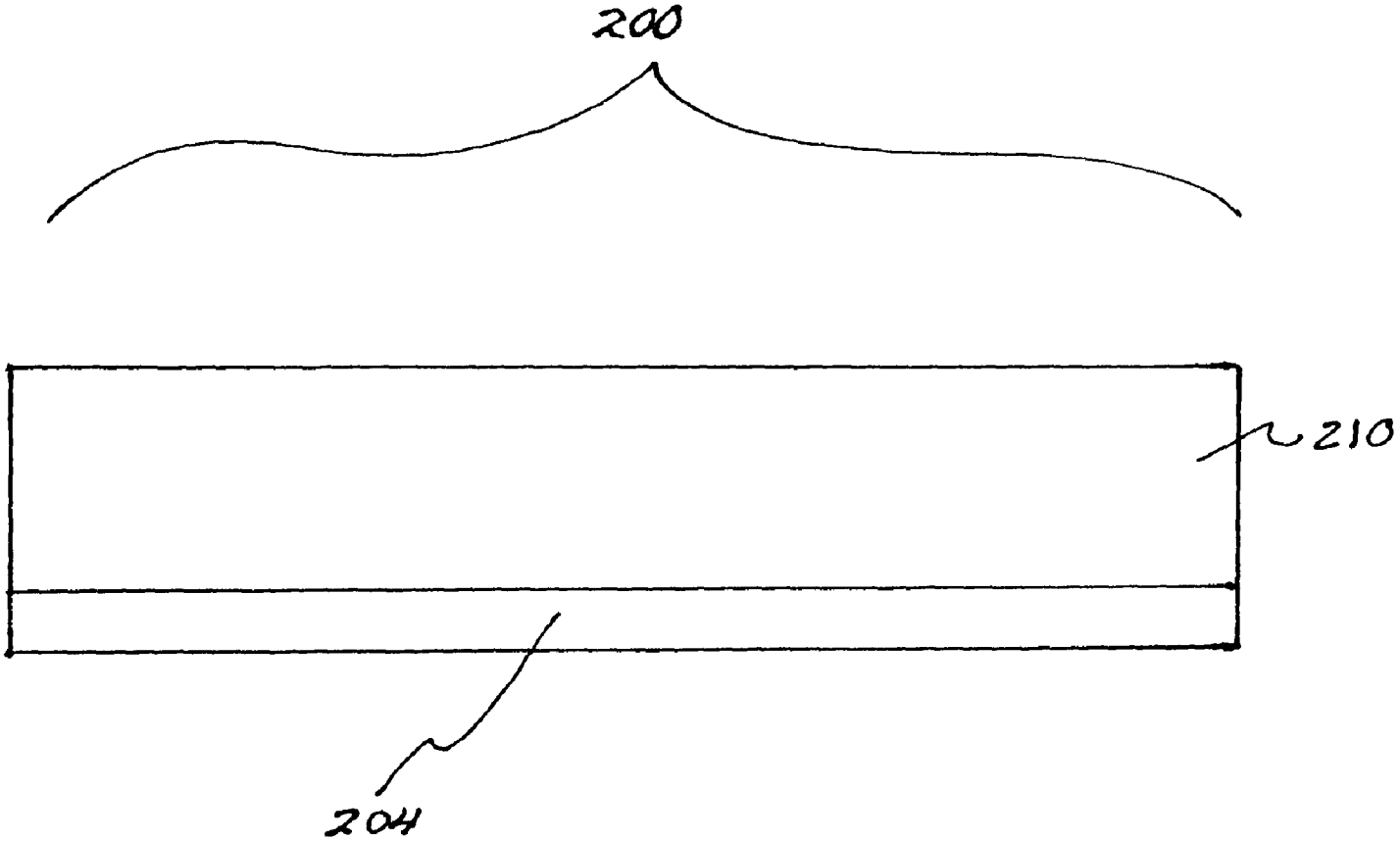
FIG. 11 is a top view of a pants hanging member.

FIG. 11 shows a top view of hanger member 200

Figure 12:
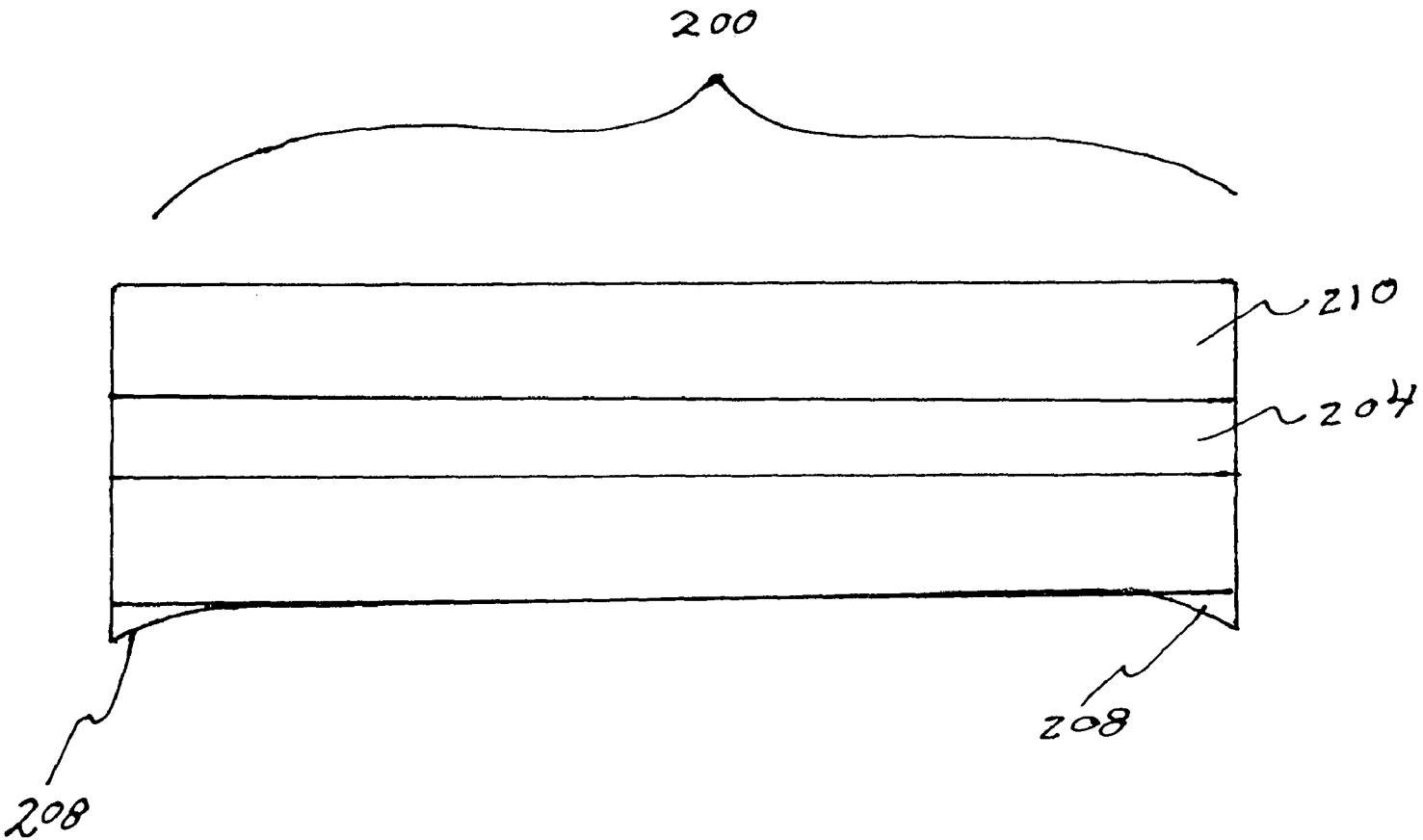
FIG. 12 is a rear view of a pants hanging member.

FIG. 12 shows a rear view of hanger member 200.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Pants hanger system comprising:

a vertically disposed hanger strip capable of being attached to a wall or door by standard means;

a plurality of horizontally disposed elongate rigid hanger receiving members;

a plurality of horizontally disposed elongate semi rigid pants hanging members;

said hanger receiving members being centrally and fixedly attached to said hanger strip in an equal spacing one above the other;

said hanger receiving members being formed into a U shaped profile;

said pants hanging members having an inverted teardrop shaped profile wherein the bottom most portion of said teardrop section includes a gap capable of removably retaining the cuff portion of a pair of pants;

the front, outwardly facing side of each said pants hanging member having a flared pant cuff receiving edge portion at each and;

the rear, wall facing side of each said pants hanging member having a horizontally disposed inverted U shaped profile portion fixedly attached; and said U shaped portion of said hanger receiving member capable of being slidably engaged with said inverted U shaped portion of said pants hanging member to removably retain said pair of pants.

2. Pants hanger system as claimed in claim 1 wherein said pants hanger members are made of resilient ABS plastic.

3. Pants hanger system as claimed in claim 1 wherein said vertical hanger strip in made flexible of polyester strap material and can be rolled up for compact storage and shipping.

4. Pants hanger system as claimed in claim 1 wherein said pants hanging members are each approximately ten inches wide and two and one quarter inches tall.

5. Pants hanger system as claimed in claim 1 wherein the distance between each said hanging member is approximately two and one quarter inches.

* * * * *